US005157949A

United States Patent [19]

Sawazaki et al.

[11] Patent Number: 5,157,949

[45] Date of Patent: Oct. 27, 1992

[54] DEVICE FOR DRIVING TAKE-UP UNIT OF CIRCULAR KNITTING MACHINE

[75] Inventors: Masatoshi Sawazaki; Kouzo Taniguchi, both of Kobe, Japan

[73] Assignee: Precision Fukuhara Works, Ltd., Hyogo, Japan

[21] Appl. No.: 643,118

[22] Filed: Jan. 18, 1991

[30] Foreign Application Priority Data

Feb. 1, 1990 [JP] Japan ..... 2-23008

[51] Int. Cl.[5] ..... D04B 15/88

[52] U.S. Cl. ..... 66/151; 66/153

[58] Field of Search ..... 66/151, 152, 153

[56] References Cited

U.S. PATENT DOCUMENTS

| | | | |
|---|---|---|---|
| 3,695,062 | 10/1972 | Schaack | 66/151 |
| 3,850,012 | 11/1974 | Bourgeois | 66/151 |
| 4,671,083 | 6/1987 | Sawazaki et al. | 66/151 |

FOREIGN PATENT DOCUMENTS

| | | | |
|---|---|---|---|
| 2411911 | 12/1977 | France | 66/152 |
| 0237493 | 9/1987 | Italy | 66/152 |

*Primary Examiner*—Werner H. Schroeder
*Assistant Examiner*—John J. Calvert
*Attorney, Agent, or Firm*—Bell, Seltzer, Park & Gibson

[57] ABSTRACT

A fabric take-up unit (5) is supported beneath the needle cylinder (4a) to rotate synchronously therewith and knitted fabric delivery rolls (11, 12, 13) are supported on the fabric take-up unit (5). The fabric delivery rolls (11, 12, 13) are normally driven in response to rotation of the take-up unit (5). In contrast to this normal drive, the knitted fabric delivery rolls (11, 12, 13) are driven by a planetary gear system including a sun gear (17) supported for rotation on the machine frame, a planet gear (18) meshing with the sun gear (17) and being supported on the take-up unit (5). The planet gear (18) is drivingly connected to the fabric delivery rolls (11, 12, 13). A drive motor (34) is fixed on the machine frame and is drivingly connected to the sun gear (17), and a control unit (50) is provided for controlling the speed of rotation of the drive motor (34) and the sun gear (17) so that the quantity of the knitted fabric taken up by the knitted fabric delivery rolls (11, 12, 13) is selectively varied by the speed of rotation of the drive motor (34) and the sun gear (17).

7 Claims, 2 Drawing Sheets

DEVICE FOR DRIVING TAKE-UP UNIT OF CIRCULAR KNITTING MACHINE

FIELD OF THE INVENTION

This invention relates generally to an improved drive device for selectively varying the rate at which the knitted fabric is taken up by the fabric take-up unit, and more particularly to such a drive device which includes a planetary gear mechanism driven by a drive motor fixed on the knitting machine frame.

BACKGROUND OF THE INVENTION

Circular fabric knit on a circular knitting machine is usually delivered from the needle cylinder by two or three delivery rolls disposed beneath the knitting unit and then wound in flattened condition on a take-up roll carried by a take-up unit supported to rotate with the needle cylinder. The rotation of the take-up unit usually drives the delivery rolls and the friction rolls on which the take-up roll is supported by a power transmission mechanism including bevel gears which rotate with rotation of the take-up unit. This power transmission mechanism also usually includes a variable speed pulley mechanism using belts and worm gears. One of the delivery rolls is usually driven by the power transmission mechanism and the other one or two delivery rolls are rotated by means of gears secured to the driven delivery roll.

In this prior art type of drive device, the rate at which the knitted fabric is to be taken up must be determined each time a different type of fabric is knit because the production rate will vary according to the fabric structure, the type of yarn to be used, the size of stitch being formed, and the tension applied to the fabric as it is taken up by the take-up unit. Thus, each time that a different type of fabric is to be knit, the drive device must be adjusted to change the size of the variable speed pulley to compensate for the changes being made in the type o fabric being knit. This adjustment of the size of the variable speed pulley is usually a "hit or miss" procedure and requires several adjustments to obtain the proper fabric take-up rate, a time-consuming operation, and a waste of improperly knit fabric.

To overcome the difficulty of the adjustment of this type of drive device, it has been proposed that a drive motor be fixed on the frame of the take-up unit so as to rotate therewith and to directly drive the delivery rolls so that the fabric is taken up in flat condition on the take-up roll in accordance with the speed at which the drive motor is rotated. However, when the drive motor is rotated with the take-up unit the electrical power supply device for the drive motor must include some type of electrical contact ring with electrical contacts in engagement with the ring for supplying electrical energy to the rotating drive motor. The use of the electrical supply contact ring and the electrical contacts engaging the same can frequently cause electrical problems for controlling the motor because of the occurrence of insufficient contact at the electrical contact points, and the generation of noise and the like. When using a servo motor as the drive motor, the number of electrical contacts used in the power supply device increases to raise the cost thereof.

SUMMARY OF THE INVENTION

With the foregoing in mind, it is an object of the present invention to eliminate the draw backs encountered in the prior art types of drive devices by providing a planetary gear mechanism which is driven by a drive motor mounted in a fixed position on the knitting machine frame and separate from the rotating fabric take-up unit, and with control means for controlling the speed of rotation of the drive motor to selectively vary the speed of rotation of the delivery rolls.

The improved drive means of the present invention operates with the take-up unit which is supported beneath the needle cylinder to rotate synchronously therewith. The take-up unit includes knitted fabric delivery rolls and a power transmission mechanism carried by the fabric take-up unit and drivingly connected to the fabric delivery rolls for normally driving the knitted fabric delivery rolls in response to rotation of the take-up unit. The improved drive means of the present invention comprises a planetary gear mechanism including a sun gear supported for rotation on the machine frame, and a planet gear meshing with the sun gear and being supported on the take-up unit. A drive motor is supported in a fixed position on the machine frame and is drivingly connected to the sun gear. Control means is provided for controlling the speed of rotation of the drive motor and the sun gear so that the quantity of the knitted fabric being delivered or taken up by the knitted fabric delivery rolls is selectively varied in accordance with the speed of rotation of the drive motor and the sun gear.

Preferably, the drive motor of the driving device is controlled so that the maximum quantity of the knitted fabric is delivered or taken up when the drive motor and the sun gear are not rotated. Also, no knitted fabric is taken up when the sun gear is rotated at the same speed as the needle cylinder, while the quantity of the knitted fabric taken up increases when the sun gear is rotated at variable speeds less than the speed of the needle cylinder.

In one embodiment of the invention, the drive motor is drivingly connected to the sun gear by means of a timing belt and timing pulleys with the drive motor being supported in a fixed position on one of the legs of the knitting machine frame. In a second embodiment, the drive motor is supported in a fixed position on a cross member connecting the lower ends of the legs and directly drives the sun gear by means of spur gears.

According to the present invention, the take-up unit revolves synchronously with the needle cylinder and the knit fabric is drawn downwardly from the needle cylinder by the delivery rolls and is rolled up by friction rolls. The driven fabric delivery rolls and the friction rolls are rotated by a planetary gear mechanism driven by a control drive motor supported in a fixed position on the machine frame and separately from the rotating take-up unit. Since the drive motor is supported in a fixed position on the machine frame and separately from the rotating take-up unit, the electrical supply wires for the drive motor may be easily installed and directly connected to the control drive motor.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 1:
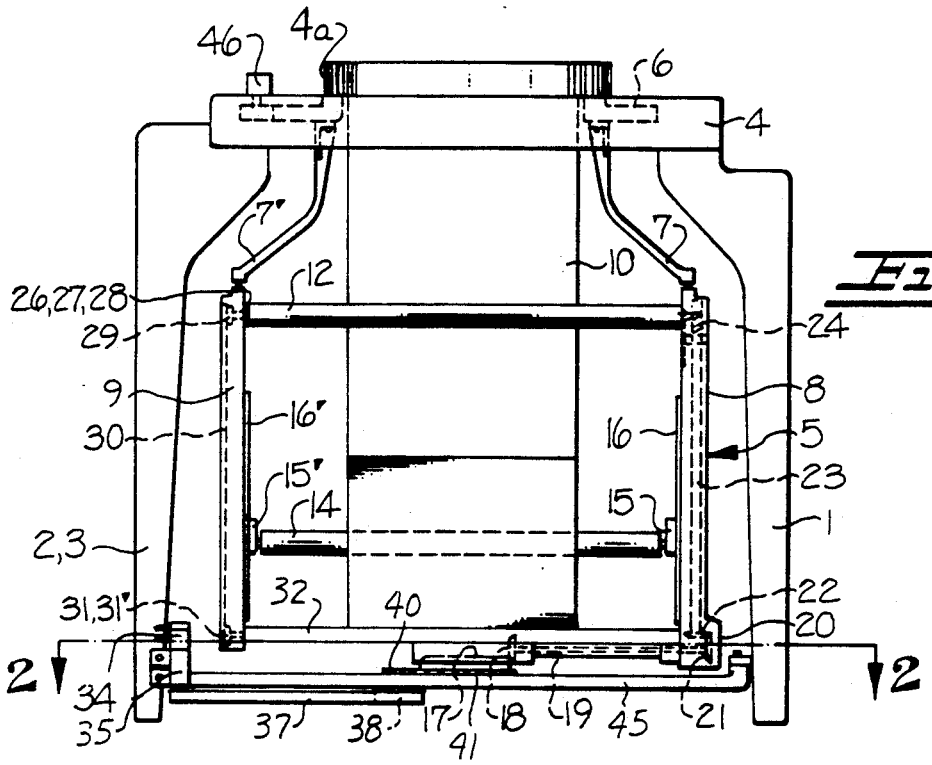
FIG. 1 is a front elevational view of the lower portion of a circular knitting machine with the first embodiment of the drive associated therewith.

As illustrated in FIG. 1, the circular knitting machine includes a vertically slotted needle cylinder 4*a* positioned above a bed plate 4 fixed on the upper ends of support legs 1, 2 and 3. The needle cylinder 4*a* is fixed to and rotated by a rotatable ring gear 6 supported for rotation in the bed plate 4. A take-up unit, broadly indicated at 5, is disposed beneath the needle cylinder 4*a* and fixed to the gear ring 6 by connecting brackets 7, 7', the upper ends of which are fixed to the bottom of the gear ring 6 and the lower ends of which are fixed to the upper ends of respective side frames 8, 9 of the take-up unit 5. Thus, the take-up unit 5 rotates synchronously with the needle cylinder 4*a* and the ring gear 6. An encoder 46 is supported on the bed plate 4 and is drivingly connected to the ring gear 6 to detect and encode the rotation of the needle cylinder 4*a* and the take-up unit 5 for transmitting data therefrom to a main control unit 50 (FIG. 6), in a manner to be presently described.

Tubular knit fabric 10 is produced by the knitting units, not shown, surrounding the needle cylinder 4*a* and extends downwardly therefrom to a plurality of delivery rolls 11, 12, 13 (FIG. 3), the opposite ends of which are supported for rotation in the side frames 8, 9. From the delivery rolls 11, 12, 13, the knit fabric 10, in flattened condition, extends to and is wound onto a take-up roll 14, opposite ends of which are rotatably supported in vertically sliding brackets 15, 15' supported for vertical sliding movement in slide frames 16, 16' carried by the side frames 8, 9 of the take-up unit 5.

Figure 3:
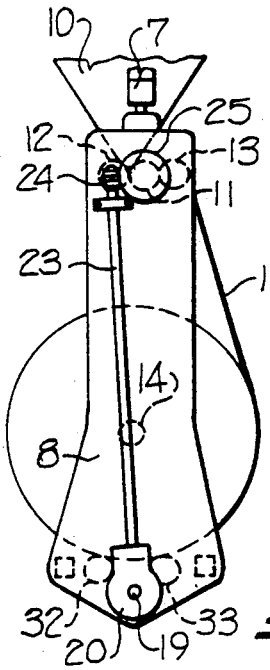
FIG. 3 is a fragmentary elevational view of the right-hand side of the rotating take-up unit of FIG. 1.

A planetary gear mechanism is supported in the lower central portion of the take-up unit 5 and includes a first bevel gear 17, defining a sun gear, and a second bevel gear 18, defining a planet gear, in driving engagement with the sun gear 17. The planet gear 18 is supported for rotation with the take-up unit 5 and is fixed to one end of a first drive shaft 19. A third bevel gear 21 is fixed to the other end of the drive shaft 19 and drivingly mates with a fourth bevel gear 22, fixed on the lower end of a second drive shaft 23 extending vertically and supported for rotation on the side frame 8 of the take-up unit 5 (FIGS. 1 and 3). The bevel gears 21, 22 are supported for rotation in a gear housing 20 on the lower end of the side frame 8. A worm 24 is fixed to the upper end of the drive shaft 23 and drivingly mates with a worm gear 25 (FIG. 3) which is fixed to one end of the center fabric delivery roll 11. The opposite end of the delivery roll 11 is provided with a spur gear 26 in driving engagement with spur gears 27, 28, fixed on the corresponding ends of the fabric delivery rolls 12, 13 so that all three fabric delivery rolls 11, 12, 13 are rotated at the same speed.

A sprocket 29 is fixed on the left-hand end of the center delivery roll 11 in FIG. 1. As illustrated in FIG. 3, the tubular fabric 10 is flattened and passes downwardly between the delivery rolls 11, 12, beneath the delivery roll 11, and over the delivery roll 13 to be directed downwardly onto the take-up roll. A sprocket chain 30 drivingly connects the sprocket wheel 29 and lower sprocket wheels 31, 31' fixed on the left-hand ends of horizontally disposed friction rolls 32, 33 (FIG. 3). The friction rolls 32, 33 support and rotate the fabric take-up roll so that the fabric delivered by the delivery rolls 11, 12, 13 is rolled up in flattened condition.

In the conventional take-up mechanism the bevel gear 17 is normally positioned and supported in a fixed and nonrotating position on the knitting machine so that the second bevel gear 18 is rotated as the second bevel gear 18 moves around the bevel gear 17 with rotation of the take-up unit 5 to impart driving movement to the delivery rolls 11, 12, 13 and the friction rolls 32, 33 so that the knit fabric 10 is taken up on the take-up roll 14. However, in accordance with the present invention, the first bevel gear or sun gear 17 is supported for rotation at variable rates of speed, in a manner to be presently described, so that the speed of rotation imparted to the sun gear 17 determines the speed of rotation imparted to the planet gear 18 and the quantity of the knit fabric 10 to be taken up by the take-up unit 5.

Figure 2:
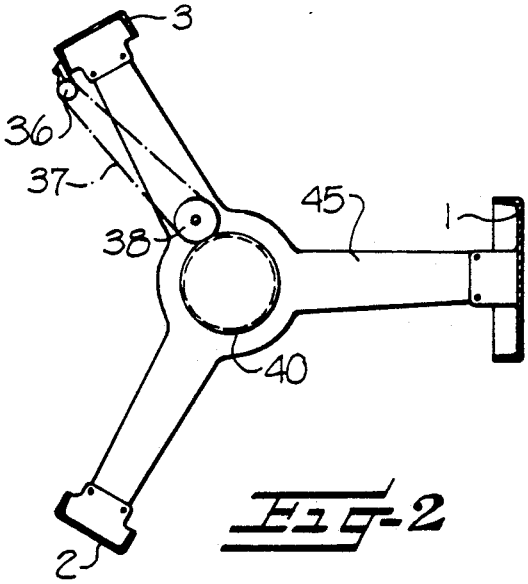
FIG. 2 is a horizontal sectional plan view taken substantially along the line 2—2 in FIG. 1.
Figure 4:
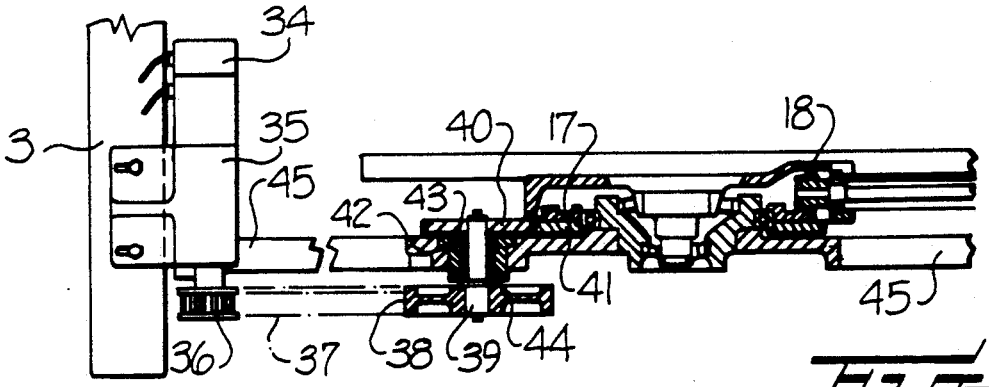
FIG. 4 is an enlarged view of the lower portion of FIG. 1, with parts in section, to illustrate the manner in which the drive motor is drivingly connected to the planetary gear mechanism.

As best shown in FIG. 4, a drive motor 34 is fixed to the lower portion of the leg 3 by means of a support housing 35. The drive motor 34 has a first timing belt pulley 36 fixed to the drive shaft thereof and drives a timing belt 37 which drivingly engages a second timing belt pulley 38. The second timing belt pulley 38 is fixed on the lower end of a drive shaft 39 which is supported for rotation in bearings 43, 44 in a bearing housing 42. The bearing housing 42 is fixed in a cross member 45 having outwardly extending radial arms connected to the respective machine legs 1, 2 and 3 (FIG. 2). A spur gear 40 is fixed to the upper end of the vertical drive shaft 39 and drivingly engages a spur gear 41, fixed on the lower surface of the sun gear 17. Thus, any rotation imparted to the timing belt 37 by the drive motor 34 is transmitted to the sun gear 17 through the timing belt 37 and the spur gears 40, 41.

Figure 5:
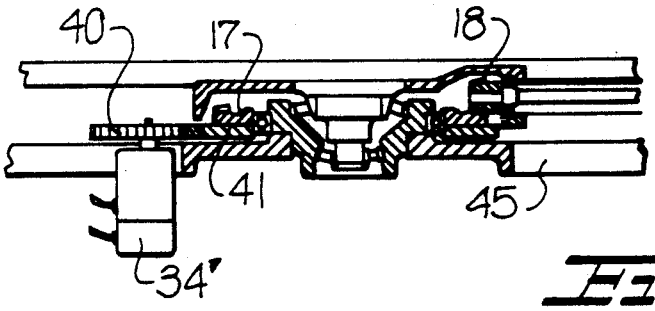
FIG. 5 is a view similar to FIG. 4 but showing a second embodiment of the drive device.

A second embodiment of the invention is illustrated in FIG. 5 where the timing belt and timing belt pulleys are eliminated. In this embodiment, a drive motor 34' is supported on the cross member 45 and the drive shaft of the drive motor 34' is directly connected to the spur gear 40, in driving engagement with the spur gear 41 to thereby rotate the sun gear 17. If desired, the spur gears 40, 41 of the first and second embodiments may be replaced by other suitable drive devices, such as bevel gears, a drive chain and sprocket, or a timing belt and timing belt pulleys.

In both embodiments shown in FIGS. 4 and 5, the planet bevel gear 18 rotates at a maximum speed when the sun gear 17 is not rotated and maintained in a fixed position so that the maximum quantity of knit fabric 10 is taken up and delivered by the delivery rolls 11, 12, 13. On the other hand, when the sun gear 17 is rotated by the drive motor 34 in the same direction and at the same speed as rotation of the needle cylinder 4*a* and the take-up unit 5, the planet bevel gear 18 does not rotate and no knit fabric is taken up by the delivery rolls 11, 12, 13. Also, the quantity of the knit fabric taken up and delivered by the delivery rolls 11, 12, 13 can be increased by controlling the speed of the motor 34 so that the sun gear 17 is rotated at a speed which is variable and less than the rotating speed of the needle cylinder 4*a* and the take-up unit 5 so that the amount of fabric taken up corresponds to the speed and rate of production of the knit fabric by the knitting machine.

Figure 6:
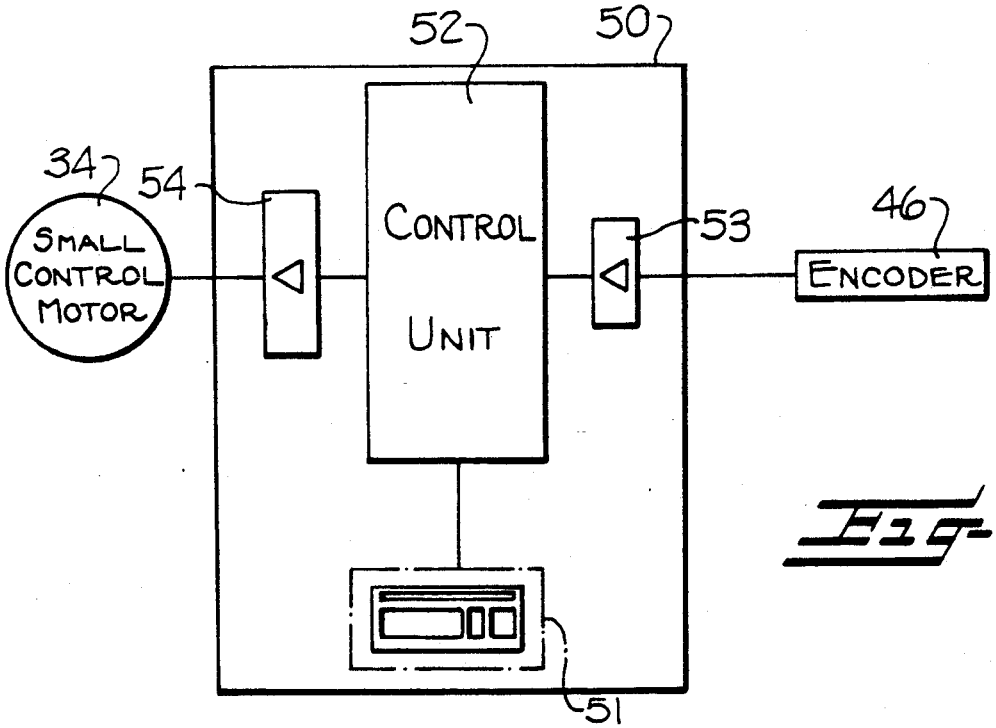
FIG. 6 is a block diagram of the control means for controlling the speed of rotation of the drive motor.

As illustrated in the block diagram of FIG. 6, the automatic motor control device 50 includes a conventional data input device 51 which may be provided with the usual known elements, such as a keyboard, ROM board, and RAM board. The input device 51 is operatively connected to a control unit 52. The input device 51 constitutes an input medium for inputting data (which is set for various conditions, based on the kind of fabric structure to be knit) into the memory of the main control means 50. Data concerning the number of revolutions of the knitting machine is obtained from the rotary encoder 46 and transmitted via an amplifier 53 to control unit 52 of control means 50. Data about fabric production, such as the texture, yarn to be used, stitch density, is obtained from the data input device 51 in terms of signals which are transmitted to the control unit 52 as data relating to the take-up speed of the fabric with respect to the rotational speed of the knitting machine through an amplifier 53. The control unit 52 is adapted to transmit correction signals to the motor 34 through an amplifier 54 when any abnormality (namely, a difference larger than a fixed valve) is found while comparing signals of the encoder 46 with the initially set data in the input device 51. On the basis of these signals, the speed of rotation of the motor 34 is controlled so as to properly correlate the rate at which the knitting machine knits the fabric, and the rate at which such fabric is taken-up by the take-up rolls of the knitting machine. More specifically in the foregoing regard, if the rate of fabric take-up is too great in relation to the rate of fabric production, the output control signal of control unit 52 reduces the speed of motor 34. If the fabric take-up rate is too small in relation to the rate at which the fabric is knitted, the output control of the signal from control unit 52 increases the speed of motor 34.

In accordance with the present invention, the drive motor 34 or 34', for controlling the speed of rotation of the sun gear 17, is supported in a fixed position on the knitting machine frame. Therefore, the electrical supply wire connection for the drive motor 34 or 34' is greatly simplified to eliminate any electrical problems which occur when the drive motor is supported to rotate with the take-up unit 5.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a machine frame comprising legs (1, 2, 3) supporting a bed plate (4), and a cross member (45) connecting the lower ends of said legs (1, 2, 3), a needle cylinder (**4*a*) supported for rotation above said bed plate (4), a fabric take-up unit (5) supported beneath said needle cylinder (4*a*) to rotate synchronously therewith, knitted fabric delivery roll means (11, 12, 13), and power transmission means carried by said fabric take-up unit (5) and drivingly connected to said knitted fabric delivery roll means (11, 12, 13), said power transmission means being normally adapted to drive said knitted fabric delivery roll means (11, 12, 13) in response to rotation of said take-up unit (5), the combination therewith of improved drive means for said knitted fabric delivery roll means (11, 12, 13) and comprising (a) a sun gear (17) supported for rotation on said cross member (45) of said machine frame, (b) a planet gear (18) meshing with said sun gear (17) and being supported on said take-up unit (5), said planet gear (18) being drivingly connected to said fabric delivery roll means (11, 12, 13), (c) a drive motor (34) having a variable speed of rotation fixed on said machine frame and drivingly connected to said sun gear (17) for imparting rotation to said sun gear, and (d) control means (50) for controlling the speed of rotation for said drive motor (34) and said sun gear (17) so that the rate at which the knitted fabric is taken up by said knitted fabric delivery roll means (11, 12, 13) is selectively varied by varying the speed of rotation of said drive motor (34) and said sun gear (17**).

2. In a circular knitting machine according to claim 1 wherein the maximum rate at which the knitted fabric is taken up occurs when said drive motor (34) and said sun gear (17) are not rotated, and the knitted fabric is not taken up when said sun gear (17) is rotated at the same speed as said needle cylinder (**4*a***).

3. In a circular knitting machine according to claim 1 wherein no knitted fabric is taken up when said sun gear (17) is rotated at the same speed as said needle cylinder (**4*a*), and wherein the rate at which the knitted fabric is taken up increases when said sun gear (17) is rotated at a speed less than that of said needle cylinder (4*a***).

4. In a circular knitting machine according to claim 1 wherein said control means (50) includes an encoder (46) driven by rotation of said needle cylinder (**4*a*) and provides data to said control means (50) for automatically controlling the speed of rotation of said driving motor (34) and said sun gear (17**) drivingly connected thereto.

5. In a circular knitting machine according to claim 4 wherein said control means (50) includes a data input device (51) operatively connected to a control unit (52).

6. In a circular knitting machine according to claim 1 wherein said drive motor (34) is drivingly connected to said sun gear (17) by means of a drive belt (37) and belt pulleys (36, 38) and spur gears (40, 41).

7. In a circular knitting machine according to claim 1 wherein said drive motor (34') is drivingly connected to said sun gear (17) by a pair of spur gears (40, 41).

* * * * *